US009314834B2

(12) United States Patent
Klein et al.

(10) Patent No.: US 9,314,834 B2
(45) Date of Patent: Apr. 19, 2016

(54) DEVICE FOR SHAPING A METAL SHEET BY DIE STAMPING

(75) Inventors: Gilles Charles Casimir Klein, Mery sur Oise (FR); Jean-Michel Patrick Maurice Franchet, Paris (FR); Gilbert Michel Marin Leconte, Ozoir la Ferriere (FR); Dominique Magnaudeix, Yerres (FR)

(73) Assignee: SNECMA, Paris (FR)

( * ) Notice: Subject to any disclaimer, the term of this patent is extended or adjusted under 35 U.S.C. 154(b) by 41 days.

(21) Appl. No.: 14/238,303

(22) PCT Filed: Aug. 9, 2012

(86) PCT No.: PCT/FR2012/051879

§ 371 (c)(1), (2), (4) Date: Feb. 11, 2014

(87) PCT Pub. No.: WO2013/021142

PCT Pub. Date: Feb. 4, 2013

(65) Prior Publication Data

US 2014/0208819 A1 Jul. 31, 2014

(30) Foreign Application Priority Data

Aug. 11, 2011 (FR) ..... 11 57307

(51) Int. Cl.

| | |
|---|---|
| ***B21D 53/78*** | (2006.01) |
| ***B21J 13/02*** | (2006.01) |
| ***B21D 22/22*** | (2006.01) |
| ***B21K 3/04*** | (2006.01) |
| *B21D 43/00* | (2006.01) |

(52) U.S. Cl.

CPC ..... *B21D 53/78* (2013.01); *B21D 22/22* (2013.01); *B21J 13/02* (2013.01); *B21K 3/04* (2013.01); *B21D 43/003* (2013.01)

(58) Field of Classification Search

CPC ..... B21D 53/78; B21D 22/022; B21D 22/22; B21D 43/003; B21D 11/14; B21D 11/02; B21J 13/02; B21K 3/04; B23P 15/02; B23P 15/04; B25B 1/2426; B25B 1/2468

USPC ..... 72/361, 299, 475, 420, 428, 31.02, 72/31.03, 293, 295, 296, 298; 29/889.7, 29/889.71, 889.72, 23.51; 269/3, 6, 95

See application file for complete search history.

(56) References Cited

U.S. PATENT DOCUMENTS 3,866,305 A * 2/1975 Conn, Jr. ..... 228/160
5,063,662 A 11/1991 Porter et al.

(Continued)

FOREIGN PATENT DOCUMENTS

EP 0 812 649 12/1997

OTHER PUBLICATIONS

International Search Report Issued Oct. 12, 2012 in PCT/FR12/051879 Filed Aug. 9, 2012.

*Primary Examiner* — Peter DungBa Vo
*Assistant Examiner* — Joshua D Anderson
(74) *Attorney, Agent, or Firm* — Oblon, McClelland, Maier & Neustadt, L.L.P.

(57) ABSTRACT

A device for shaping a metal sheet by die stamping, the device including first and second trunnions configured to be fastened respectively to two opposite ends of a sheet, the sheet being configured to be shaped by die stamping, wherein the first and second trunnions define respective first and second bearing surfaces configured respectively to guide turning of the trunnions, the first bearing surface defining a peripheral groove around a pivot axis of the first trunnion while the second bearing surface is smooth along a pivot axis of the second trunnion.

13 Claims, 2 Drawing Sheets

(56) References Cited

U.S. PATENT DOCUMENTS 5,636,440 A * 6/1997 Bichon et al. ..... 29/889.72
5,933,951 A 8/1999 Bergue et al.
6,210,630 B1 4/2001 Bergue et al.
6,959,572 B2 * 11/2005 Lawrence et al. ..... 72/31.03
2010/0116013 A1 * 5/2010 Brennand ..... 72/311

* cited by examiner

DEVICE FOR SHAPING A METAL SHEET BY DIE STAMPING

FIELD OF THE INVENTION

The invention relates to a device for shaping a metal sheet by die stamping and to a method using such a device in particular for the purpose of making protective reinforcement for the leading edge of an airfoil (e.g. a turbine engine blade, a helicopter blade, or a propeller blade).

STATE OF THE PRIOR ART

In the field of aviation, and more particularly in the field of airplane turbojets, reducing the weight of elements constituting the turbojet is an ongoing concern. This concern has led to fan blades or guide vanes being developed in which the airfoils are made of organic matrix composite material, where such composite airfoils are lighter than metal airfoils.

Nevertheless, the leading edges of such composite airfoils are too sensitive to erosion and to potential impacts (from birds, gravel, ice, sand, etc.) to allow them to be used without protection. That is why it is known to protect such leading edges with the help of protective reinforcement.

Some kinds of protective reinforcement are made by assembling together metal sheets that have been forged by die stamping and that are assembled while hot around a high-strength alloy core. The assembly is then subjected to heat treatment in order to weld the two sheets together. Thereafter the core is withdrawn so as to obtain the final part. An example of reinforcement of this type is described in French patent applications Nos. 11/50169 and 11/50532, that have been filed but not yet published.

Die stamping is a forging operation that consists in plastically deforming the sheet by placing it between two dies and then subjecting it to one or more stamping operations so as to obtain a forged sheet of dimensions and three-dimensional shape that are close to or equal to the dimensions and shape of the final part. A difficulty in that operation lies with keeping the sheet in position relative to the portions in relief (projections or indentations) of the dies as they move towards each other, since the sheet tends to slip along the slopes of those portions in relief. Unfortunately, such slipping leads to the imprint for the core being offset relative to the outer profile of the sheet. Since two sheets are assembled together in order to form the protective reinforcement, any such offset makes the operation of assembling the sheet together more complicated (and might even make it impossible). This happens in particular when the sheets are assembled together by electron beam welding, since that type of welding requires the sheets to be very accurately positioned relative to each other.

In order to limit that problem of a sheet slipping during die stamping, one solution consists in providing abutments around the portions in relief, as described in the European patent application published under the number EP 2 295 164 A2. Nevertheless, during die stamping, that solution does not give full satisfaction since the points where the part bears against the abutments vary in different manners, such that the above-mentioned problem of slipping may remain even if it is limited. Furthermore, the shapes and the numbers of the abutments that need to be provided on the dies make the dies more complicated to fabricate. It is necessary to provide a number of abutments that is proportional to the size of the part to be die stamped in order to ensure that the sheets do not slip. Unfortunately, forming each abutment requires deep machining in the dies and, in order to be effective, the abutments need to be machined with profiles that are accurate.

There therefore exists a need for another device that is exempt, at least in part, of the above-mentioned drawbacks.

SUMMARY OF THE INVENTION

The present description relates to a device for shaping a metal sheet by die stamping, the device comprising first and second trunnions configured to be fastened respectively to two opposite ends of a sheet, the sheet being adapted to be shaped by die stamping, wherein the first and second trunnions define respective first and second bearing surfaces configured to guide turning of the trunnions.

Advantageously, the first bearing surface defines a peripheral groove around the pivot axis of the first trunnion while the second bearing surface is smooth along the pivot axis of the second trunnion.

The term "trunnion" is used to designate a part that, on being fastened to said sheet, enables the sheet to turn about said pivot axes and that provides a bearing surface during turning. The pivot axes of the trunnions may be in alignment or not in alignment. In most circumstances, whether or not they are in alignment, it is preferable for the axes of the trunnions to be mutually parallel. Nevertheless, for certain shapes of parts to be die stamped, it is possible to work with trunnions that are not parallel with each other. Advantageously, the trunnions are compact, i.e. they occupy little space, so they may easily be received in the top and bottom dies used for die stamping. This makes the dies easier to fabricate. For example, the bearing surfaces of the trunnions may be inscribed in respective cylindrical surfaces of revolution, of circular section and having the pivot axes of the trunnions as their axes of revolution. The cylindrical surface of revolution is of small diameter and in particular its diameter is less than or substantially equal to the length (or height) of the trunnion.

In certain embodiments, the trunnions are configured to be removable from the sheet. The trunnions then present the advantage of being recoverable, reusable, and exchangeable.

As described in detail below, such trunnions enable the sheet to be permanently positioned during die stamping, while still allowing the two ends of the sheet to be shaped in opposite directions (without shear in the connection zones between the trunnions and the sheet). By means of said peripheral groove, the first trunnion contributes to positioning the part laterally and longitudinally, while the second trunnion contributes to positioning the part laterally.

The term "longitudinally" is used to designate positioning along said pivot axes. The term "laterally" is used to designate positioning in a direction perpendicular to a pivot axis and to the direction in which the dies move towards each other during die stamping.

In certain embodiments, each of the first and second trunnions presents a respective slot extending along said pivot axis, the slot being configured to receive a portion of said sheet. Such a slot serves to fasten (partially) the sheet to the trunnion, in particular by constraining these two elements to turn together about said pivot axis.

In certain embodiments, each trunnion is fitted with a pin extending across said slot. More precisely, each trunnion may present a hole that crosses the slot and that is configured to receive the pin. Under such circumstances, the sheet presents a hole that is configured to pass the pin. The pin in association with the slot serves to secure the sheet to the corresponding trunnion, and in particular to constrain these elements to turn together about the pivot axis of the trunnion and to move together in translation along said axis.

In certain embodiments, said pins are removable, such that the trunnions can be separated from the sheet after die stamping and used again with another sheet.

In certain embodiments, the device further comprises two first columns, each extending along a main axis substantially perpendicular to the pivot axis of the first trunnion, these first columns being configured to receive the first trunnion between them, the two first columns being arranged on either side of the first trunnion.

When the first trunnion presents a peripheral groove, the first two columns are arranged on either side of the first trunnion in said peripheral groove in such a manner as to prevent the first trunnion from moving in translation in a direction perpendicular to said main axes and to said pivot axis, and to prevent the first trunnion from moving in translation along its pivot axis. In other words, the first columns co-operate with the first trunnion, in particular with the peripheral groove in which they are engaged, so as to provide both lateral and longitudinal positioning of the trunnion while still allowing it to turn during shaping of the sheet.

In certain embodiments, each of the two first columns presents a chamfered top end defining first, second, and third flats, the two first flats defining a V-shaped space between them facilitating placing the first trunnion between the two first columns, whereas the second and third flats of a given column are opposite relative to the main axis of the column so that the top end of the column tapers. These tapering ends also make it easier to place the first trunnion between the two first columns, and more precisely make it easier to engage the first columns in the peripheral groove.

In certain embodiments, the device further comprises two second columns, each extending along a main axis substantially perpendicular to the pivot axis of the second trunnion, these second columns being configured to receive the second trunnion between them, the second columns being arranged on either side of the second trunnion in such a manner as to prevent the second trunnion from moving in translation in a direction perpendicular to said main axes and to said pivot axis, while allowing the second trunnion to move in translation along its pivot axis.

In other words, the second columns co-operate with the second trunnion so as to provide lateral positioning of the second trunnion, while allowing it to turn during shaping of the sheet.

The fact that the second trunnion can move in translation along its pivot axis makes it possible to avoid being hindered by movement of the trunnions relative to each other in the longitudinal direction of the sheet. This is of particular advantage when the die stamping leads to significant longitudinal deformation of the sheet. This also presents a particular advantage when the sheet is subjected to a phenomenon of thermal expansion/contraction causing its length to vary. By way of example, such a phenomenon may appear during the cooling of a hot sheet while it is being transferred to the die. Under such circumstances, regardless of the magnitude of the contraction of the sheet (which magnitude can be difficult to predict accurately), the first and second trunnions can be arranged without difficulty between the first and second columns, respectively.

In certain embodiments, each of the second columns presents a chamfered top end defining a respective flat, the two flats defining a V-shaped space between them facilitating placing the second trunnion between the two columns.

It can be understood that the co-operation between the first trunnion and the first columns, and the co-operation between the second trunnion and the second columns serves to ensure that the sheet is positioned laterally while allowing it to turn, and in particular while allowing the two end portions of the sheet to turn in opposite directions while it is being shaped. Furthermore, when the first trunnion is provided with a peripheral groove, co-operation between the peripheral groove and the first columns serves to ensure that the sheet is positioned longitudinally. In addition, as mentioned above, the trunnions are made easy to put into place and they perform properly in mechanical terms, even in the event of the sheet expanding/contracting longitudinally.

In certain embodiments, the device further comprises top and bottom dies configured to receive said sheet between them and to shape the sheet by the dies moving towards each other, the top and bottom dies having cavities for receiving the trunnions and any columns while the dies move towards each other.

In certain embodiments, the columns are fastened to one of the dies. For example, all of the columns may be fastened to the bottom die, while the top die presents cavities into which the top end portions of the columns penetrate when the dies move towards each other.

The present description also relates to an assembly comprising a metal sheet adapted to be shaped by die stamping together with the above-described device. The first and second trunnions of the device are then fastened respectively to said opposite ends of the sheet.

In certain embodiments, the sheet presents two tongues extending from said opposite ends of the sheet, these tongues being configured to be inserted in the slots of the trunnions.

The term "tongue" is used to designate portions of the sheet that extend beyond the working zone of the sheet, i.e. the zone that is to be shaped, and that are advantageously of a width that is smaller than the width of the working zone. For example, the tongues may have a width corresponding substantially to the width of the trunnions. These tongues will be cut off once the sheet has been shaped. The thickness of the tongues may be the same as the thickness of the sheet.

In certain embodiments, each tongue has a through hole configured to have one of said pins passing therethrough so as to hold the sheet in position relative to the corresponding trunnion.

The present description also relates to a method of shaping a metal sheet by die stamping, in which the above-described device is used, the first and second trunnions of the device being fastened respectively to said opposite ends of the sheet.

In certain implementations, said sheet is shaped to form at least a portion of a piece of protective reinforcement for the leading edge of an airfoil.

The above-mentioned characteristics and advantages of the invention, together with others, appear on reading the following detailed description of one or more embodiments of the invention. This detailed description is made with reference to the accompanying drawings.

BRIEF DESCRIPTION OF THE DRAWINGS

The accompanying drawings are diagrammatic, and they seek above all to illustrate the principles of the invention.

In the drawings, elements (or portions of an element) that are analogous from one figure to another are identified by the same reference signs.

DETAILED DESCRIPTION OF EMBODIMENTS

Figure 1:
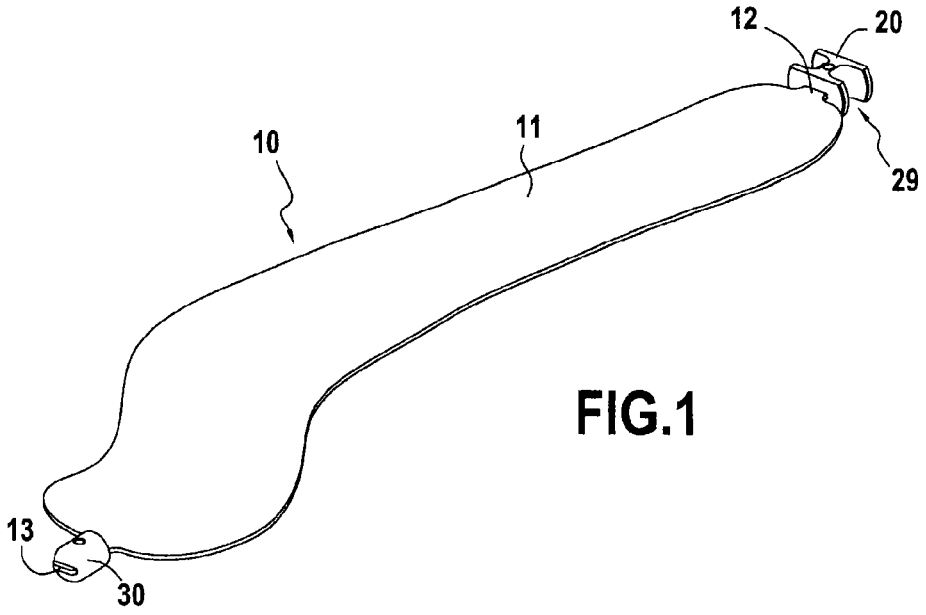
FIG. 1 is a perspective view of a metal sheet that is to be shaped by die stamping, the sheet being fitted with first and second trunnions at its longitudinal ends.
Figure 2:
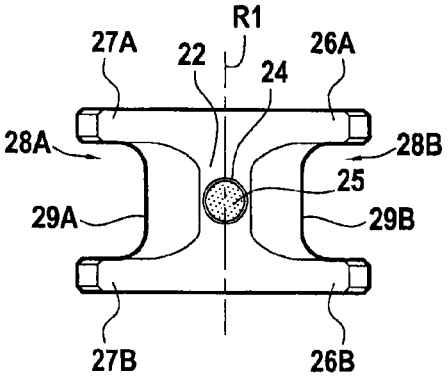
FIG. 2 is a plan view of the first trunnion of FIG. 1.
Figure 4:
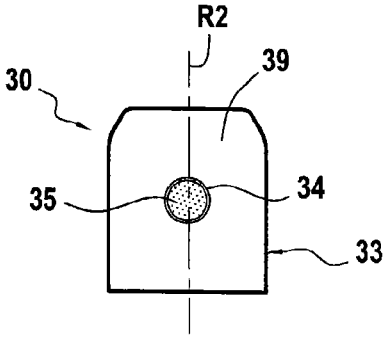
FIG. 4 is a plan view of the second trunnion of FIG. 1.
Figure 8:
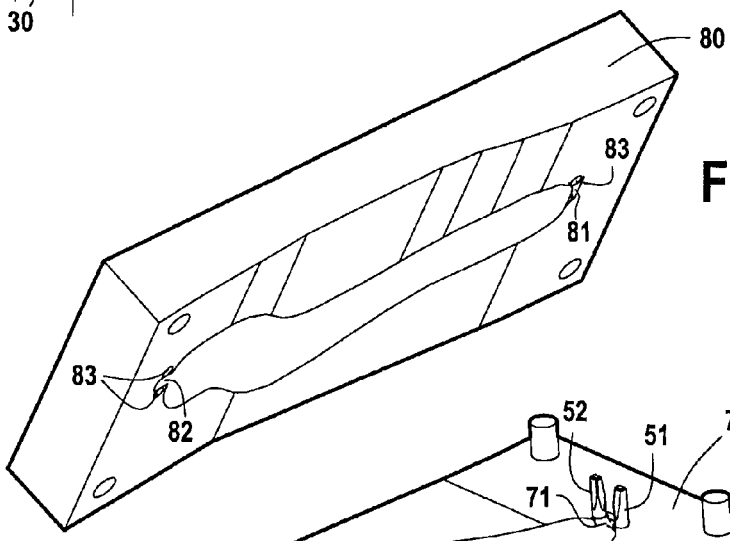
FIG. 8 is a perspective view of the top die used for shaping the sheet of FIG. 1.
Figure 7:
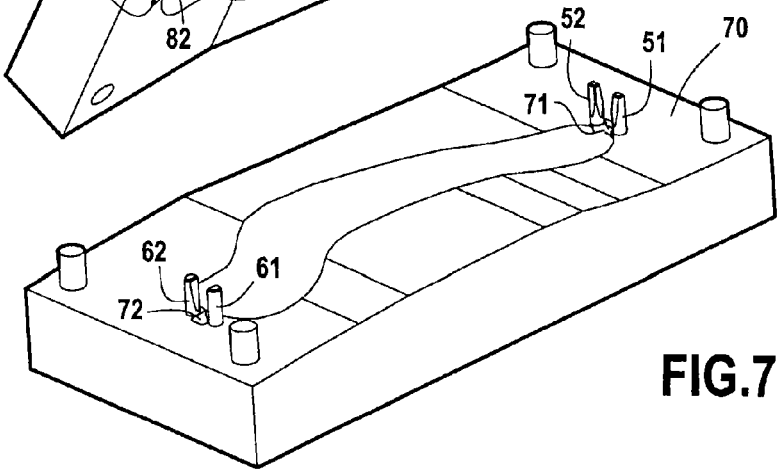
FIG. 7 is a perspective view of the bottom die used for shaping the sheet of FIG. 1.

FIG. 1 shows a flat metal sheet 10 that is to be shaped by die stamping between the bottom and top sides of FIGS. 7 and 8.

The sheet 10 has a working zone 11 corresponding to the zone that is to be shaped, and at opposite ends of the working zone 11, it has two tongues 12 and 13 projecting in opposite directions. In this example, the sheet 10 is for shaping so as to provide half of the reinforcement for protecting the leading edge of an airfoil, with the tongues being placed level with the root and the tip of the airfoil and being centered on the construction axis of the assembled airfoil.

The tongue 12 is fastened to a first trunnion 20, while the tongue 13 is fastened to a second trunnion 30.

Figure 3:
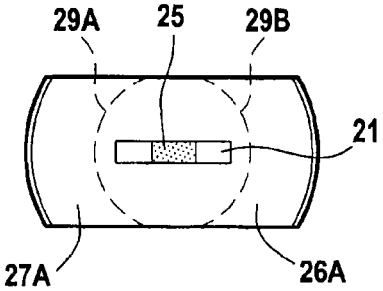
FIG. 3 is a face view of the first trunnion of FIG. 1.
Figure 6:
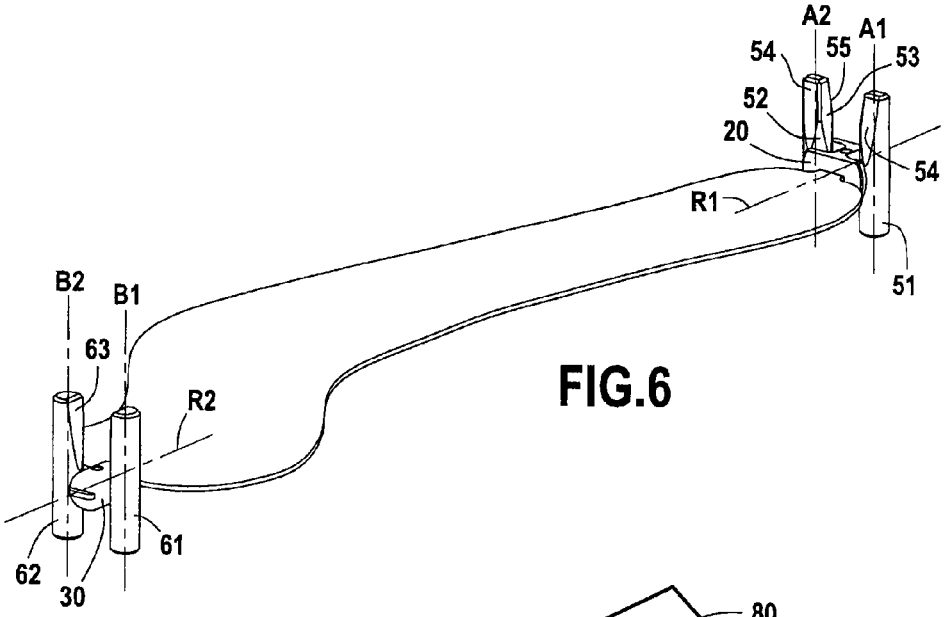
FIG. 6 is a perspective view of the assembly of FIG. 1 with the first and second columns surrounding the first and second trunnions, respectively.

The trunnions 20 and 30 are configured to pivot about respective pivot axes R1 and R2 drawn in chain-dotted lines in FIGS. 3 and 6. When they are fastened to said sheet 10, the trunnions 20 and 30 allow the sheet to turn about said pivot axes R1 and R2 while providing support during such turning. In this example, the pivot axes R1 and R2 are not in alignment.

The first trunnion 20 has a central portion 22 having a slot 21 passing therethrough parallel to the pivot axis R1. The shape and the dimensions of the slot 21 are adapted to receive the tongue 12 of the sheet (see FIG. 1). The central portion 22 may also have a hole 24 passing therethrough, which hole extends perpendicularly to the pivot axis R1 and crosses the slot 21. This hole 24 is configured to receive a pin (or key) 25. Once the pin 25 is engaged in the hole 24, the pin 25 crosses the slot 21, as shown in FIG. 3.

On either side of the central portion 22, the first trunnion 20 presents a respective pair of fins, giving a total of four fins 26A, 26B, 27A, and 27B. Each fin extends substantially in a plane perpendicular to the pivot axis R1. In other words, the proximal fins 26A and 26B and the distal fins 27A and 27B form respectively a proximal plate and a distal plate on either side of the middle portion of the central portion 22 (the adjectives "proximal" and "distal" being used with reference to the connection with the sheet 10). Each pair of fins thus co-operates with the central portion 22 of the trunnion 20 to define a notch. These two notches 28A and 28B formed on either side of the trunnion 20 form an outer peripheral groove 28 around the trunnion, this groove 28 extending perpendicularly to the pivot axis R1. The bottom surface 29A, 29B of each notch 28A, 28B is generally semicylindrical in shape about the pivot axis R1. These surfaces 29A and 29B are drawn in dashed lines in FIG. 3. The bottom surfaces 29A and 29B provide bearing surfaces while the trunnion 20 is turning about the axis R1.

The second trunnion 30 comprises a cylindrical peg 39 defining a cylindrical side surface 33 of revolution about the pivot axis R2 as its axis of revolution. This cylindrical side surface 33 serves as a bearing surface during turning of the trunnion 30 about the axis R2.

Figure 5:
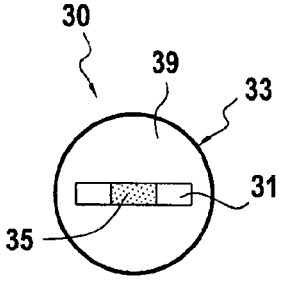
FIG. 5 is a face view of the second trunnion of FIG. 1.

The cylindrical peg 39 has a slot 31 passing therethrough parallel to the pivot axis R2. The shape and the dimensions of the slot 31 are adapted to receive the tongue 13 of the sheet 10 (see FIG. 1). The peg 39 also has a hole 34 passing therethrough, the hole extending perpendicularly to the pivot axis R2 and crossing the slot 31. This hole 34 is configured to receive a pin 35. Once the pin 35 is engaged in the hole 34, the pin 35 crosses the slot 31, as shown in FIG. 5.

Both of the tongues 12 and 13 present a respective hole (not shown) passing through its thickness. It can be understood that by inserting the tongues 12 and 13 into the slots 21 and 31 and by causing the holes in the tongues 12 and 13 to coincide with the holes 24 and 34 in the trunnions 20 and 30, and by engaging the pins 25 and 35 in these holes, it is possible to prevent any relative movement between the trunnions 20, 30 and the sheet 10. In particular, the trunnions 20 and 30 are constrained to turn with the sheet 10 about the axes R1 and R2.

This example device also has two first columns 51 and 52 extending along respective mutually parallel main axes A1 and A2 that are perpendicular to the pivot axis R1. Each column 51, 52 presents a chamfered top end defining first, second, and third flats 53 to 55. The two first flats 53 of the two columns face each other and define a V-shaped space between them that facilitates installing the first trunnion 20 between the first columns 51 and 52, while the second and third flats 54 and 55 of a given column are opposite about the main axis A1 (or A2) of the column 51 (or 52) so that the top end of each column tapers. This tapering top end makes it easier to pass the columns 51 and 52 through the outer peripheral groove 28 of the trunnion 20 (and more precisely through the notches 28A and 28B, respectively).

The device further comprises: two second columns 61 and 62 each extending along a main axis B1 or B2 perpendicular to the pivot axis R2 of the second trunnion 30. Each second column 61, 62 presents a chamfered top end defining a respective flat 63. The two flats 63 of the two columns face each other and define a V-shaped space between them facilitating positioning the second trunnion 30 between the second columns 61 and 62.

The device also has top and bottom dies 80 and 70 configured to receive the sheet 10 between them and to shape the sheet 10 by die stamping. These dies 70 and 80 are shown in FIGS. 7 and 8. FIGS. 7 and 8 are diagrammatic, in particular concerning the recesses in the dies.

In this example, the four columns 51, 52, 61, and 62 are carried by the bottom die 70 and are secured thereto, as shown in FIG. 7. The bottom die 70 also has cavities 71 and 72 for receiving the respective trunnions 20 and 30 when the dies are moved towards each other.

The top die 80 has cavities 81 and 82 for receiving the respective trunnions 20 and 30 when the dies are moved towards each other, and other cavities 83 for receiving the free ends of the four columns 51, 52, 61, and 62 as the dies move towards each other.

FIG. 6 shows the assembly constituted by the sheet 10 and the trunnions 20 and 30 fastened to the sheet, the assembly being put into place between the four columns 51, 52, 61, and 62 prior to the die-stamping operation. For reasons of clarity, the top and bottom dies 80 and 70 are not shown in FIG. 6. While said assembly is being put into place, the trunnion 20 is engaged between the columns 51 and 52 so that the columns 51 and 52 are held in the annular peripheral groove 28 of the trunnion 20 on either side of the central portion 22. The trunnion 30 is engaged between the columns 61 and 62.

Engaging the trunnions 20 and 30 between the columns 51 & 52 and 61 & 62 serves to ensure that the sheet 10 is positioned laterally and longitudinally relative to the dies 70 and 80 both before and during the shaping (i.e. die stamping) of the sheet. In addition, this engagement allows the trunnions to turn, and thus allows the sheet to turn while it is being shaped. In particular, the two end portions of the sheet 10 are free to turn in opposite directions.

In practice, the sheet 10 and the trunnions 20 and 30 are heated in an oven to several hundreds of degrees (e.g. in the range 900° C. to 1000° C.) prior to being positioned between the dies 70 and 80 and between the columns 51 & 52 and 61 & 62. Between leaving the oven and being positioned between the columns, the sheet may contract as a result of cooling. Whatever the amplitude of this contraction, the sheet and the trunnions can be put into place between the columns 51 & 52 and 61 & 62 because the trunnion 30 presents a bearing surface that is smooth along the pivot axis R2 and can therefore be positioned between the columns 61 and 62 with a certain amount of tolerance along the axis R2.

The embodiments or implementations described in the present description are given by way of non-limiting illustration, and, in the light of this description, a person skilled in the art can easily modify these implementations or embodiments, or can envisage others, while remaining within the scope of the invention.

Furthermore, the various characteristics of these implementations or embodiments can be used on their own or can be combined with one another. When they are combined, these characteristics may be combined as described above or they may be combined differently, the invention not being limiting to the specific combinations described in the present description. In particular, unless specified to the contrary, a characteristic that is described with reference to one particular implementation or embodiment may be applied in analogous manner to another implementation or embodiment.

The invention claimed is:

1. A device for shaping a metal sheet by die stamping, the device comprising:

first and second trunnions configured to be fastened respectively to two opposite ends of a sheet, the sheet adapted to be shaped by die stamping, wherein the first trunnion defines a first bearing surface and the second trunnion defines a second bearing surface, the first and second bearing surfaces configured respectively to guide turning of the trunnions, and wherein the first bearing surface defining a peripheral groove around a pivot axis of the first trunnion while the second bearing surface is smooth along a pivot axis of the second trunnion, thereby allowing the second trunnion to move in translation along the pivot axis of the second trunnion and preventing the first trunnion from moving in translation along the pivot axis of the first trunnion.

2. A device according to claim 1, wherein each of the first and second trunnions includes a respective slot oriented along the respective pivot axis of the respective trunnion, the slot being configured to receive a portion of the sheet.

3. A device according to claim 2, wherein each trunnion is fitted with a pin extending across the slot.

4. A device according to claim 1, further comprising:

two first columns, each first column extending along a main axis substantially perpendicular to the pivot axis of the first trunnion, the first columns being configured to receive the first trunnion therebetween, the two first columns arranged on either side of the first trunnion in the peripheral groove to prevent the first trunnion from moving in translation in a direction perpendicular to the main axes and to the pivot axis, and to prevent the first trunnion from moving in translation along the pivot axis of the first trunnion.

5. A device according to claim 4, wherein each of the two first columns presents a chamfered top end defining first, second, and third flats, the two first flats defining a V-shaped space between the first flats, whereas the second and third flats of a given column are opposite relative to the main axis of the column so that a top end of the column tapers.

6. A device according to claim 1, further comprising:

two second columns, each second column extending along a main axis substantially perpendicular to the pivot axis of the second trunnion, the second columns being configured to receive the second trunnion therebetween, the second columns being arranged on either side of the second trunnion to prevent the second trunnion from moving in translation in a direction perpendicular to the main axes and to the pivot axis, while allowing the second trunnion to move in translation along the pivot axis of the second trunnion.

7. A device according to claim 6, wherein each of the second columns presents a chamfered top end defining two respective flats, the two respective flats defining a V-shaped space therebetween.

8. A device according to claim 1, further comprising top and bottom dies configured to receive the sheet therebetween and to shape the sheet by the dies moving towards each other, the top and bottom dies including cavities for receiving the trunnions and any columns while the dies move towards each other.

9. A device according to claim 1, wherein the first trunnion presents four fins extending in a plane perpendicular to the pivot axis of the first trunnion.

10. A device according to claim 9, wherein a central body of the first trunnion and a first pair of the tins define a first notch, the central body of the first trunnion and a second pair of the tins define the second notch, and the first and second notches define the peripheral groove of the first trunnion.

11. A device according to claim 1, wherein the second trunnion comprises a cylindrical peg defining a cylindrical side surface of revolution about the pivot axis of the second trunnion as an axis of revolution of the cylindrical side surface.

12. An assembly comprising a sheet adapted to be shaped by die stamping and a device according to claim 1.

13. An assembly according to claim 12, wherein the sheet includes two tongues extending from opposite ends of the sheet, the tongues being configured to be inserted in respective slots of the trunnions.

* * * * *